US005371523A

United States Patent [19]

Wada et al.

[11] Patent Number: 5,371,523

[45] Date of Patent: Dec. 6, 1994

[54] MULTIPRINT INK SHEET RECORDING APPARATUS

[75] Inventors: Satoshi Wada, Kawasaki; Takehiro Yoshida, Tokyo; Makoto Kobayashi, Tama; Hisao Terajima, Yokohama; Takeshi Ono, Yokohama; Minoru Yokoyama, Yokohama; Takashi Awai, Yokohama; Yasushi Ishida, Tokyo; Akihiro Tomoda, Yokohama, all of Japan

[73] Assignee: Canon Kabushiki Kaisha, Tokyo, Japan

[21] Appl. No.: 201,051

[22] Filed: Feb. 24, 1994

Related U.S. Application Data

[63] Continuation of Ser. No. 71,339, Jun. 2, 1993, abandoned, which is a continuation of Ser. No. 431,829, Nov. 6, 1989, abandoned.

[30] Foreign Application Priority Data

Nov. 9, 1988 [JP] Japan ..... 63-281373

[51] Int. Cl.[5] ..... B41J 2/325

[52] U.S. Cl. ..... 346/76 PH; 347/61

[58] Field of Search ..... 346/1.1, 76 PH; 400/207 C, 237 C, 249, 227.1, 227.2, 120, 703

[56] References Cited

U.S. PATENT DOCUMENTS

| | | | |
|---|---|---|---|
| 4,456,392 | 6/1984 | Nozaki et al. | 400/120 |
| 4,463,359 | 7/1984 | Ayata et al. | 346/1.1 |
| 4,520,373 | 5/1985 | Ayata et al. | 346/140 R |
| 4,636,810 | 1/1987 | Asakura et al. | 346/76 PH |
| 4,760,405 | 7/1988 | Nagira et al. | 346/76 PH |
| 4,814,789 | 3/1989 | Ono | 346/76 PH |
| 4,837,813 | 6/1989 | Terajima | 379/113 |
| 4,907,902 | 3/1990 | Doi | 400/249 |

FOREIGN PATENT DOCUMENTS

| | | | |
|---|---|---|---|
| 3635779 | 4/1987 | Germany . | |
| 58-201686 | 11/1983 | Japan . | |
| 0179286 | 9/1985 | Japan | 400/249 |
| 61-189977 | 8/1986 | Japan . | |
| 62-23775 | 1/1987 | Japan . | |
| 62-95273 | 5/1987 | Japan | 346/76 PH |
| 61-22778 | 6/1987 | Japan | 346/76 PH |
| 0231978 | 9/1988 | Japan | 400/249 |
| 0314185 | 12/1989 | Japan | 400/207 C |
| 2175253 | 11/1986 | United Kingdom . | |

*Primary Examiner*—Benjamin R. Fuller
*Assistant Examiner*—N. Le
*Attorney, Agent, or Firm*—Fitzpatrick, Cella, Harper & Scinto

[57] ABSTRACT

A heat transfer recording apparatus for transferring the ink of an ink sheet to a recording medium to thereby effect recording of images one the recording medium has an ink sheet loading portion for loading the ink sheet therein, discriminating means for discriminating the number of times of possible recording of the ink sheet loaded in the ink sheet loading portion, recording means for acting on the ink sheet to effect recording on the recording medium, and control means for setting the number of times of possible recording to a predetermined value when the number of times of possible recording of the ink sheet cannot be discriminated by the discriminating means, and controlling the conveyance of the ink sheet and the recording medium.

11 Claims, 6 Drawing Sheets

| FIG. 3A | FIG. 3B |
|---|---|

MULTIPRINT INK SHEET RECORDING APPARATUS

This application is a continuation-in-part of application Ser. No. 08/071,339 filed Jun. 2, 1993 abandoned, which is a continuation of application Ser. No. 07/431,829 filed Nov. 6, 1989, abandoned.

BACKGROUND OF THE INVENTION

1. Field of the Invention

This invention relates to a heat transfer recording apparatus and a facsimile apparatus for transferring the ink of an ink sheet to a recording medium to thereby effect recording of images on the recording medium.

The term "heat transfer recording apparatus" covers, in addition to the facsimile apparatus, for example, an electronic typewriter, a copying apparatus, a printer, etc.

2. Related Background Art

Generally, a heat transfer printer uses an ink sheet comprising a base film having heat-meltable (or heat-sublimating) ink applied thereto, and selectively heats the ink sheet corresponding to an image signal by a thermal head and transfers the melted (or sublimated) ink to recording paper to thereby accomplish image recording. Generally, this ink sheet is one in which the ink is completely transferred to the recording paper by one time of image recording (a so-called one-time sheet) and therefore, after the termination of the recording of one character or one line, it has been necessary to convey the ink sheet by an amount corresponding to the length of the record, and then reliably bring the unused portion of the ink sheet to a recording position. Therefore, the amount of ink sheets used is increased, and this has led to the tendency that as compared with an ordinary thermosensitive printer for effecting recording on thermosensitive paper, the running cost of the heat transfer printer becomes high.

In order to solve such a problem, as seen in U.S. Pat. No. 4,456,392, Japanese Laid-Open Patent Application No. 58-201686 and Japanese Patent Publication (examined) No. 62-58917, there have been proposed heat transfer printers in which recording paper and an ink sheet are conveyed with a velocity difference provided therebetween. As is described in the aforementioned publications, an ink sheet capable of plural (n) times of image recording (a so-called multiprint sheet) is known. If such ink sheet is used, when a record length L is to be continuously recorded, recording can be accomplished with the conveyance length of the ink sheet which is conveyed after or during each image recording being made smaller than that length L ($L/n$: $n>1$). Thereby, the efficiency of use of the ink sheet increases to n times that before, and a reduction in the running cost of the heat transfer printer can be expected. This recording system will hereinafter be referred to as multiprint.

However, in the multiprint using such an ink sheet, as seen in the aforementioned publications, the distance by which the ink sheet is conveyed relative to the recording paper is always set to the same length. This means that the number of multiprints is always fixed, and for example, when use is made of an ink sheet in which the number of times of multiprint is set to five times, if the number of times of multiprint by the heat transfer printer is greater than five times, the recording density will become thin, but if the number of times of multiprint is less than five times, the recording density will become great, while the amount of the ink sheet used will increase. Also, in the future, with the advance of technology, it is expected that an ink sheet capable of further increasing the number of times of multiprint or an ink sheet capable of multiprint at various number of times is developed. Therefore, there has been desired the realization of a heat transfer printer in which the number of times of multiprint corresponding to the frequency of use of the ink sheet can be set and a facsimile apparatus using such a heat transfer printer. Also, when an ink sheet capable of a greater number of times of multiprint is replaced with an ink sheet capable of a lesser number of times of multiprint, multiprint will be executed at the original number of times until the frequency of repeated use of that replacing ink sheet is input. This has led to the undesirable possibility that when the ink sheet is newly replaced with an ink sheet permitting a lesser frequency of repeated use, the recording density thereof becomes lower.

SUMMARY OF THE INVENTION

It is an object of the present invention to provide a heat transfer recording apparatus and a facsimile apparatus which can improve the quality of images.

It is another object of the present invention to provide a heat transfer recording apparatus and a facsimile apparatus in which the amount of ink sheets consumed can be decreased.

It is still another object of the present invention to provide a heat transfer recording apparatus and a facsimile apparatus of which the running cost can be reduced.

It is yet still another object of the present invention to provide a heat transfer recording apparatus and a facsimile apparatus in which the number of times of multiprint can be designated correspondingly to the frequency of repeated use of an ink sheet and when the frequency of repeated use of the ink sheet is unclear, the frequency of repeated use is set to a minimum value,

DESCRIPTION OF THE PREFERRED EMBODIMENT

A heat transfer recording apparatus and a facsimile apparatus which will hereinafter be described and to which an embodiment of the present invention is applied operates such that when the replacement of an ink sheet is detected by detecting means for detecting whether the ink sheet has been replaced with another, the frequency of repeated use is set to a minimum value until the frequency of use of that ink sheet is indicated and on the basis of that frequency of use, the amount of conveyance of the ink sheet is determined and the ink sheet is conveyed correspondingly to the determined amount of conveyance each time a predetermined length of image recording is effected on a recording medium.

A preferred embodiment of the present invention will hereinafter be described in detail with reference to the accompanying drawings.

Figure 1:
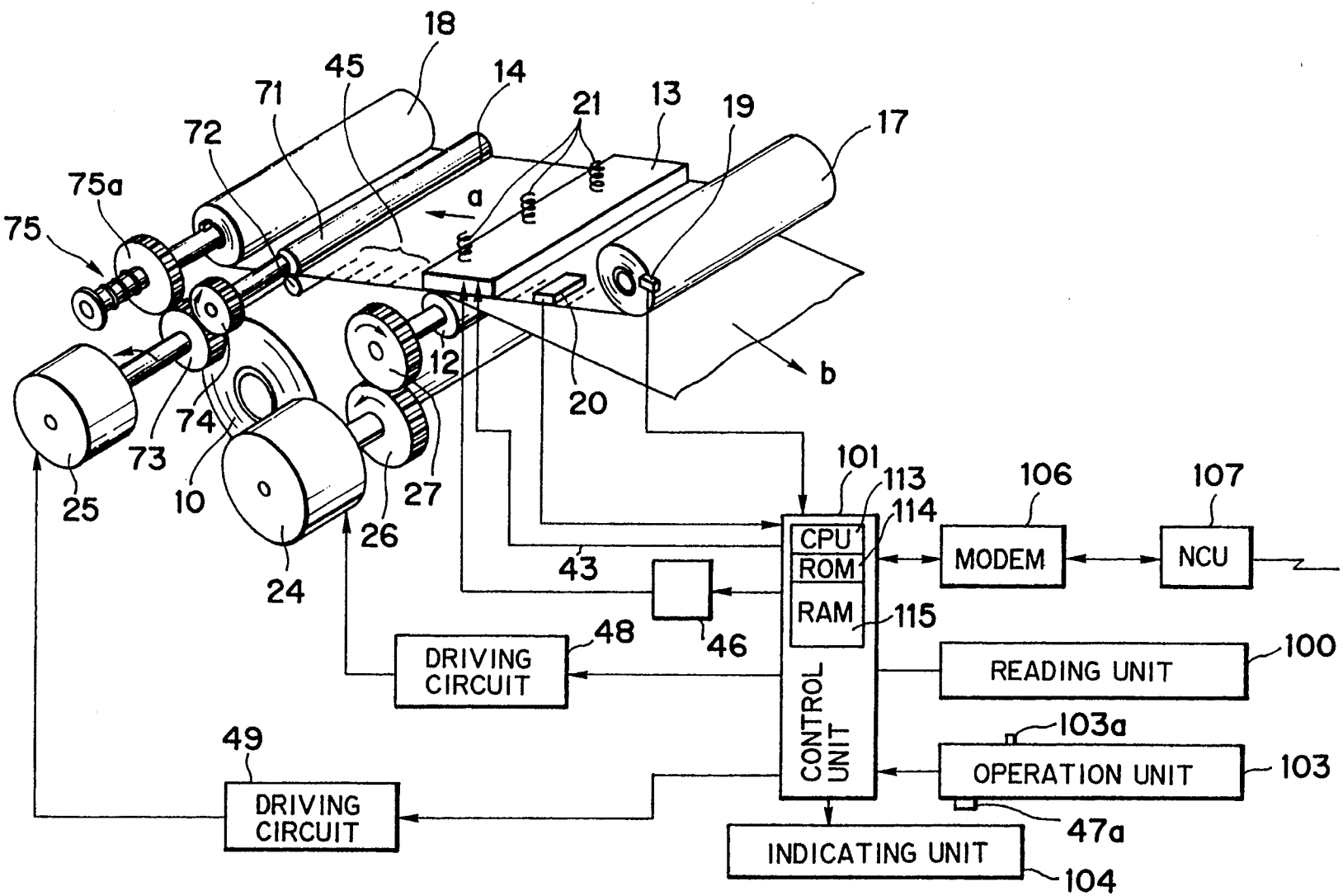
FIG. 1 is a block diagram schematically showing the construction of a facsimile apparatus to which an embodiment of the present invention is applied and the construction of a conveying drive system for recording paper and an ink sheet.

Description of Facsimile Apparatus (FIGS. 1 and 2)

Figure 2A:
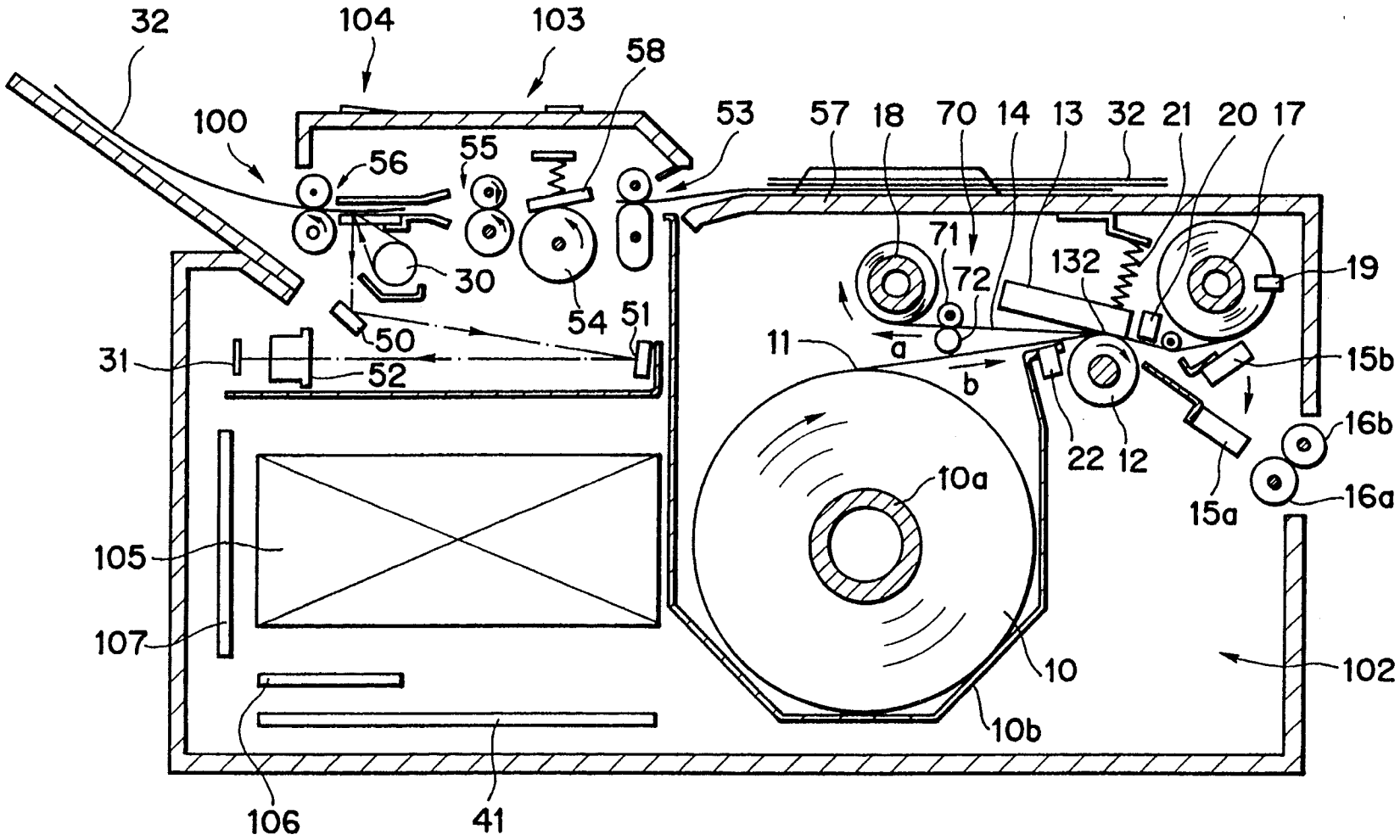
FIG. 2 is a side sectional view showing the mechanism portion of a facsimile apparatus to which an embodiment of the present invention is applied.
FIG. 2B is a pictorial perspective view of the facsimile apparatus.
Figure 2B:
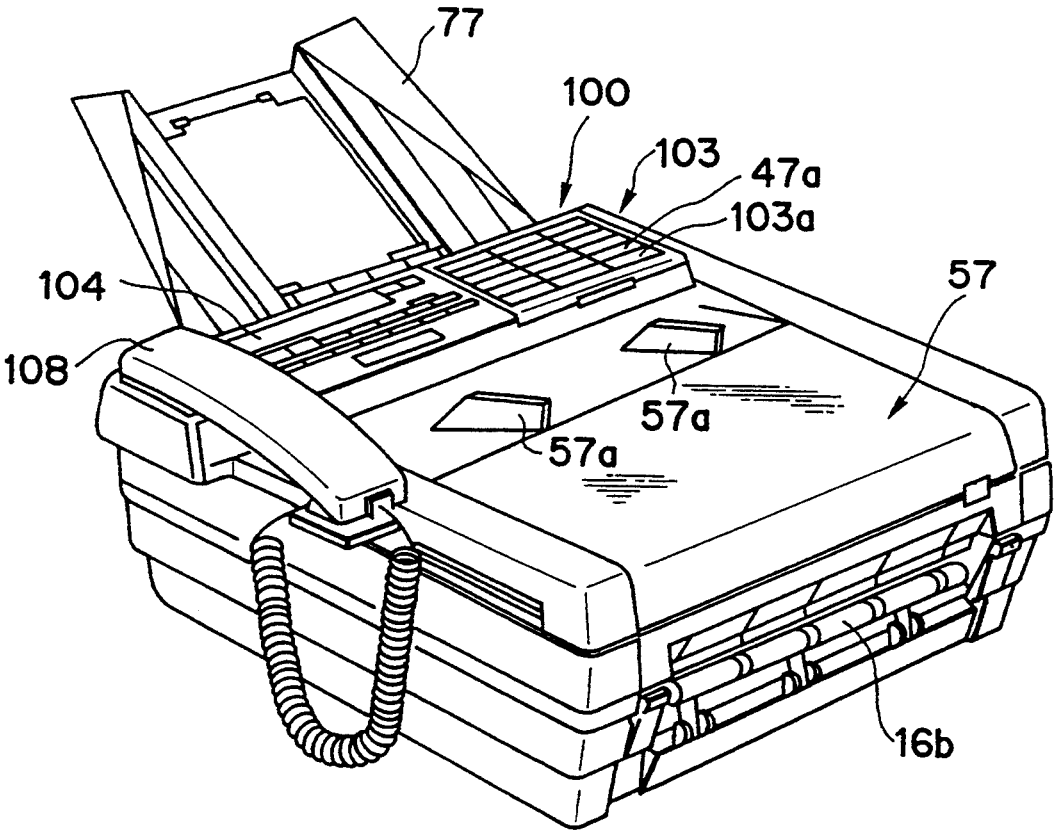

FIG. 1 is a block diagram schematically showing the construction of a facsimile apparatus when a heat transfer printer according to an embodiment of the present invention is applied thereto, FIG. 2A is a side sectional view of this facsimile apparatus, and FIG. 2B is a pictorial perspective view of the facsimile apparatus.

The construction will first be schematically described with reference to FIG. 1.

In FIG. 1, the reference numeral 100 designates a reading unit for photoelectrically reading an original and outputting it as a digital image signal to a control unit 101, and the reading unit 100 is provided with an original conveying motor, a CCD image sensor, etc. The control unit 101 controls the entire facsimile apparatus, and encodes the image data from the reading unit 100 and transmits the encoded data through a modem 106 and an NCU 107. Also, during reception, the control unit decodes the encoded image data and converts it into image data, and outputs the image data to a recording unit provided with a thermal head 13, etc., thereby reproducing the image data. The control unit 101 is provided with a CPU 113 for outputting various control signals in accordance with a control program stored in a ROM 114, the ROM 114 storing therein the control program of the CPU 113 and various data, a RAM 115 for temporarily preserving various data therein as the work area of the CPU 113, etc.

The reference numeral 103 denotes an operation unit including keys for indicating various functions such as the starting of transmission, a telephone number input key, etc. This operation unit 103, as will be described later, includes a key **47*a* such as a dip switch capable of reading the number of times of multiprint printed on an ink sheet or an ink sheet cartridge and automatically setting the number of times of multiprint, and in addition, manually setting the number of times of multiprint singly by this apparatus as required. The reference character 103*a* designates a switch for indicating to the control unit 101 that a multiprint ink sheet is mounted. The reference numeral 104 denotes an indicating unit usually provided in the operation unit 103 to indicate various functions, the state of the apparatus, etc. The reference numeral 106 designates a modem (demodulator), and the reference numeral 107** denotes a net control unit (NCU).

Before describing the construction of the recording unit shown in FIG. 1, description will first be made with reference to FIG. 2A which is a side sectional view of the facsimile apparatus and FIG. 2B which is a pictorial perspective view of the facsimile apparatus. In FIGS. 2A and 2B, portions common to those in FIG. 1 are designated by identical reference numerals.

In FIG. 2A, the reference numeral 10 designates a roll of paper comprising recording paper 11 which is plain paper wound into the form of a roll on a core **10*a*. This roll of paper 10 is rotatably contained in the apparatus so that the recording paper 11 can be supplied to the thermal head 13 by the rotation of a platen roller 12 in the direction of arrow. Denoted by 10*b* is a roll-of-paper loading portion in which the roll of paper 10 is removably loaded. The platen roller 12 conveys the recording paper 11 in the direction of arrow b and also presses the ink sheet 14 and the recording paper 11 between it and the heat generating member 132 of the thermal head 13. The recording paper 11 on which image recording has been effected by the heat generation of the thermal head 13 is conveyed toward exhaust rollers 16 (16*a* and 16*b*) by further rotation of the platen roller 12, and when image recording of one page is terminated, the recording paper 11 is cut into a page unit by the meshing engagement between cutters 15 (15*a* and 15*b***) and is exhausted.

The reference numeral 17 denotes an ink sheet supply roll on which the ink sheet 14 is wound. The reference numeral 71 designates a capstan roller, and the reference numeral 72 denotes a pinch roller. Both the capstan roller 71 and the pinch roller 72 are driven by an ink sheet conveying motor 25 which will be described later, and convey the ink sheet 14 in the direction opposite to the direction of conveyance of the recording paper 11, i.e., the direction of arrow a. The reference numeral 18 designates a take-up roller also driven by the ink sheet conveying motor 25 to take up the ink sheet 14 by an amount conveyed by the rollers 71 and 72. The ink sheet supply roll 17 and the ink sheet take-up roll 18 are removably loaded in an ink sheet loading portion within the apparatus body. The reference numeral 19 denotes an exchange sensor for detecting the exchange of the ink sheet 14, and the reference numeral 20 designates an ink sheet sensor for detecting the remaining amount of the ink sheet 14 and the value of the frequency n of repeated use of the ink sheet 14. The reference numeral 21 denotes a spring for urging the thermal head 13 against the platen roller 12 with the recording paper 11 and the ink sheet 14 interposed therebetween. The reference numeral 22 designates a recording paper sensor for detecting the presence or absence of the recording paper.

The construction of the reading unit 100 will now be described.

In FIG. 2A, the reference numeral 30 denotes a light source for irradiating an original 32. The light reflected by the original 32 is input to a CCD sensor 31 through an optical system (mirrors 50, 51 and a lens 52) and converted into an electrical signal. The original 32 is conveyed corresponding to the recording speed for the original 32, by conveying rollers 53, 54, 55 and 56 driven by an original conveying motor, not shown. The reference numeral 57 designates an original supporting table. A plurality of originals 32 supported on this supporting table 57 are separated one by one by the cooperation between the conveying roller 54 and a press-separating piece 58 while being guided by a slider **57*a*, and are conveyed to the reading unit 100 and read thereby, whereafter they are discharged onto a tray 77**.

The reference numeral 41 denotes a control base plate constituting the essential portion of the control unit 101. Various control signals are output from this control base plate 41 to the various portions of the apparatus. The reference numeral 105 designates a voltage source unit which supplies electric power to the entire apparatus, the reference numeral 106 denotes a modem base plate unit, the reference numeral 107 designates an NCU base plate unit, and the reference numeral 108 denotes a telephone set.

In FIG. 1, there is shown in detail a conveying system for the recording paper 11 and the ink sheet 14 in the recording unit. The reference numerals 73 and 74 designate reduction gears, and the reference numeral 75 denotes a slide clutch unit. When the ink sheet conveying motor 25 and the recording paper conveying motor 24 are driven, the value of the reduction gear ratio $i_I$ by the reduction gears 73 and 74 and the value of the reduction gear ratio $i_P$ by the gears 26 and 27 are suitably set, whereby the number of times n of multiprint can be set. Here, n may be changed by the number of driving steps of the recording paper conveying motor 24 and the ink sheet conveying motor 25 so that various n's can be coped with correspondingly to the kind of the ink sheet 14. Also, by the gear 73 being engaged with the gear 75*a* of the slide clutch 75, the take-up roll 18 can take up the ink sheet 14 conveyed by the capstan roller 71 and the pinch roller 72.

By setting the ratio of the gear 73 and the gear 75*a* so that the length of the ink sheet 14 taken up onto the take-up roll 18 by the rotation of the gear 75*a* becomes greater than the length of the ink sheet conveyed by the capstan roller 71, the ink sheet 14 conveyed by the capstan roller 71 is reliably taken up onto the take-up roll 18. An amount corresponding to the difference between the amount of the ink sheet 14 taken up by the take-up roll 18 and the amount of the ink sheet 14 conveyed by the capstan roller 71 is absorbed by the slide clutch unit 75. Thereby, the functuation of the amount of conveyance of the ink sheet 14 (the variation in the value of n) caused by the fluctuation of the take-up diameter of the take-up roller 18 can be suppressed.

The thermal head 13 is a line head, and receives as inputs serial recording data for one line, a latch signal, etc. from the control unit 101 by a signal line 43, and divides the heat generating element 132 comprising a plurality of heat generating resistant members for one line into a plurality of blocks and drives the heat generating element, thereby effecting the recording of one line. The reference numeral 46 designates a driving circuit for receiving as an input the driving signal of the thermal head 13 from the control unit 101 and outputting a strobe signal 44 for driving the thermal head 13 at each block unit. The reference numerals 48 and 49 denote motor driving circuits for rotatively driving the corresponding recording paper conveying motor 24 and ink sheet conveying motor 25, respectively. In this embodiment, the recording paper conveying motor 24 and the ink sheet conveying motor 25 are stepping motors, whereas they are not restricted thereto, but may be, for example, DC motors or the like.

By the directions of conveyance of the recording paper 11 and the ink sheet 14 being thus made opposite to each other, the direction in which images are successively recorded lengthwise of the recording paper 11 (i.e., the direction of arrow a which is opposite to the direction of conveyance of the recording paper 11) coincides with the direction of conveyance of the ink sheet. Here, when the conveyance velocity $V_P$ of the recording paper 11 is $V_P = -n \cdot V_I$ ($V_I$ is the conveyance velocity of the ink sheet 14, and the sign-indicates that the direction of conveyance of the recording paper 11 differs from the direction of conveyance of the ink sheet 14), the relative velocity $V_{PI}$ of the recording paper 11 and the ink sheet 14 as seen from the thermal head 13 is represented by $V_{PI} = V_P - V_I = (1 + 1/n)V_P$, and it is seen that the relative velocity is greater than $V_P$.

Figures 3, 3A:
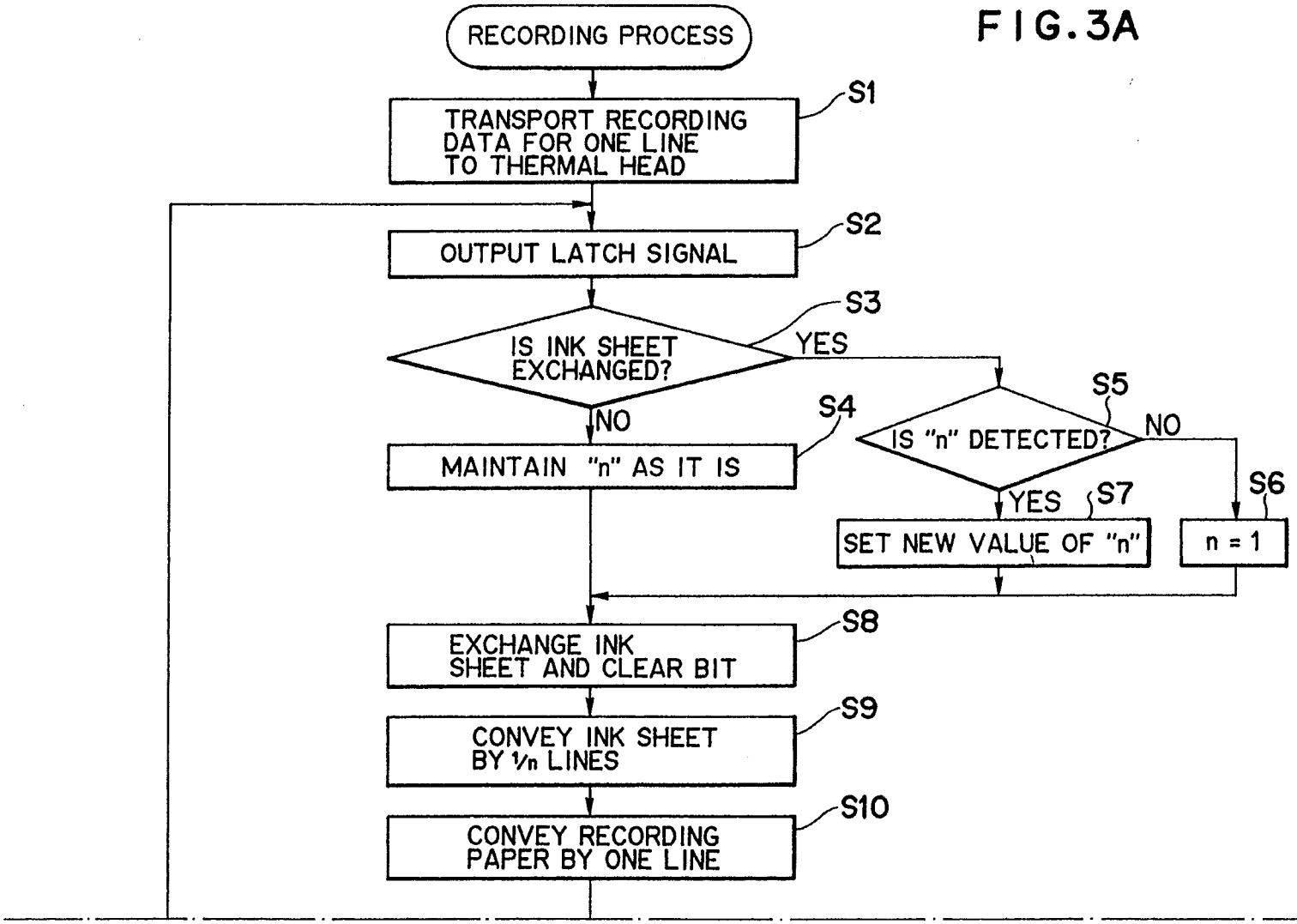
FIG. 3, 3A and 3B are flow charts showing the recording process in the facsimile apparatus.
Figure 3B:
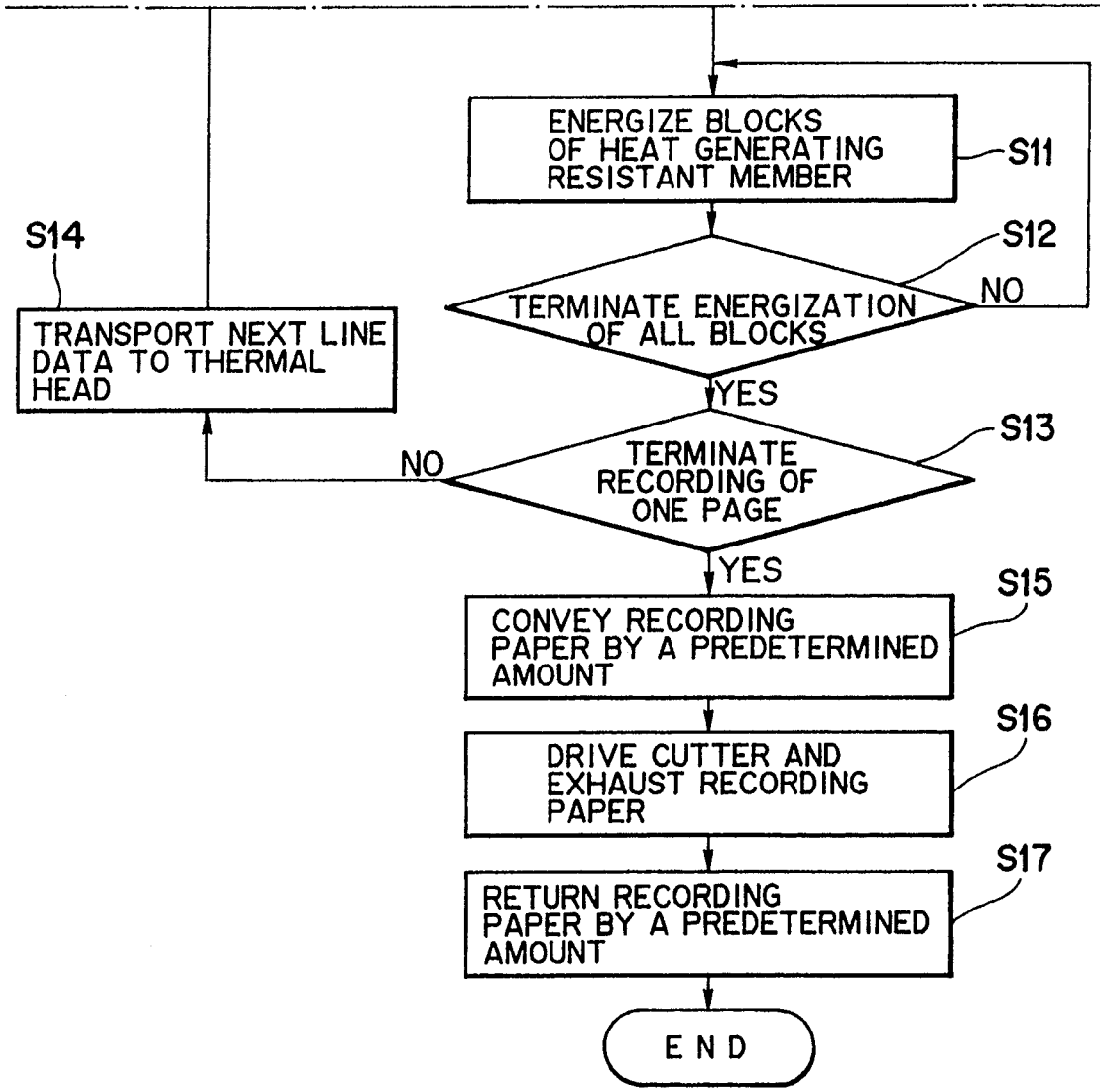

Description of the Recording Operation (FIGS. 1–3)

FIG. 3 is a flow chart showing the recording process for one page in the facsimile apparatus of the present embodiment, and a control program for executing this process is stored in the ROM 114 of the control unit 101.

This process is started by an image signal being received and image data for one line to be 10 recorded being stored into the memory of the control unit 101 to thereby bring about a condition in which the recording operation can be started. First, at step S1, recording data for one line is serially output to the thermal head 13. When the transport of the recording data for one line is terminated, at step S2, a latch signal is output and the recording data for one line is stored into the latch circuit of the thermal head 13. Subsequently, at step S3, whether the ink sheet 14 has been exchanged is examined. If the ink sheet 14 is not exchanged, advance is made to step S4, where the value of n is maintained as it is and advance is made to step S8. The detection of whether the ink sheet 14 has been exchanged is accomplished by setting an exchange flag in the RAM 115 when at a step S, not shown, the exchange of the ink sheet 14 has been detected by the exchange sensor 19, and checking the flag. The RAM 115 may desirably be non-volatile with it being taken into account that the power source switch of the apparatus is opened.

On the other hand, when at step S3, the ink sheet 14 is exchanged, advance is made to step S5, where whether the value of n could be detected is examined. The detection of the value of n is accomplished by reading an information zone 45 marked on the ink sheet 14 by the ink sheet sensor 20. When the value of n could be detected, at step S7, the read value of n is set and a new value of n is set, and advance is made to step S8. When the value of n cannot be detected at step S5, advance is made to step S6, where n is set to "1" which is minimum (this indicates that the frequency of repeated use is one time), and advance is made to step S8. At the step S8, the ink sheet exchange flag provided in the aforementioned RAM 115 is cleared. Here, as the case where the value of n cannot be detected, there is conceivable, for example, a case where the ink sheet is an ordinary one-time ribbon which is not given the information zone 45, or a case where the ink sheet is a multiprint ink ribbon which is designed such that the operator manually inputs the value of n and which is not given the information zone 45, or a case where the operator has forgotten to manually input the value of n, or a case where only a limited location on the ink ribbon is given the information zone and the recording operation must progress until the information is detected.

Advance is then made to step S9, where the amount of conveyance of the ink sheet 14 is determined on the basis of the value of n set at the preceding process step, and the ink sheet is conveyed by 1/n lines in the direction of arrow a in FIG. 1. At step S10, the recording paper conveying motor 24 is driven to convey the recording paper 11 by an amount corresponding to one line in the direction of arrow b. In the facsimile apparatus, this length corresponding to one line is set to, for example about 1/15.4 mm, and the amounts of conveyance of the recording paper 11 and the ink sheet 14 can be set by changing the energization pulse numbers of the recording paper conveying motor 24 and the ink sheet conveying motor 25.

It is to be understood that the recording paper conveying motor 24 and the ink sheet conveying motor 25 are both driven by 1–2 phase energization and are energized twenty times for the recording paper 11 to be conveyed by one line by one time of energization and for the ink sheet 14 to be conveyed by the same length. For example, when the number of times n of multiprint is "5" and when the recording paper is conveyed by one line, the ink sheet 14 is energized four times and conveyed by 1/5 line, and the conveyance distance thereof is $1/(15.4\times5)$ mm.

Advance is then made to step S11, where each block of the heat generating element 132 of the thermal head 13 is electrically energized. At step S12, whether all blocks have been electrically energized is examined, and when all blocks of the heat generating element 132 are electrically energized and the image recording of one line is terminated, advance is made to step S13, where whether the image recording of one page has been terminated is examined. If the image recording of one page is not terminated, advance is made to step S14, where the recording data for the next line is transported to the thermal head 13, and return is made to the step S2.

Subsequently, when at step S13, the image recording of one page is terminated, advance is made to step S15, where the recording paper 11 is conveyed by a predetermined amount toward the exhaust roller **16*a* and 16*b*. At step S16, the cutters 15*a* and 15*b* are driven into meshing engagement with each other to thereby cut the recording paper 11 into a page unit. Subsequently, at step S17, the recording paper 11 is returned by a distance corresponding to the spacing between the thermal head 13 and the cutters 15**, whereby the image recording process for one page is terminated.

In the series of cutting processes for the recording paper 11 by the cutters 15 at the steps S15–S17, the ink sheet 14 when the recording paper 11 is conveyed may be conveyed at a velocity of $V_P/n$ in the direction opposite to the direction of conveyance of the recording paper 11 as during recording and the value of n may be made greater than that during recording. Also, the same movement as that of the recording paper 11 may be effected by the platen roller 12, or the ink sheet may remain stopped without being moved.

Also, if at the step S6, the value of n cannot be detected, n may be set on the basis of the value indicated by the manually operated key 47a of the operation unit 103.

Figure 4:
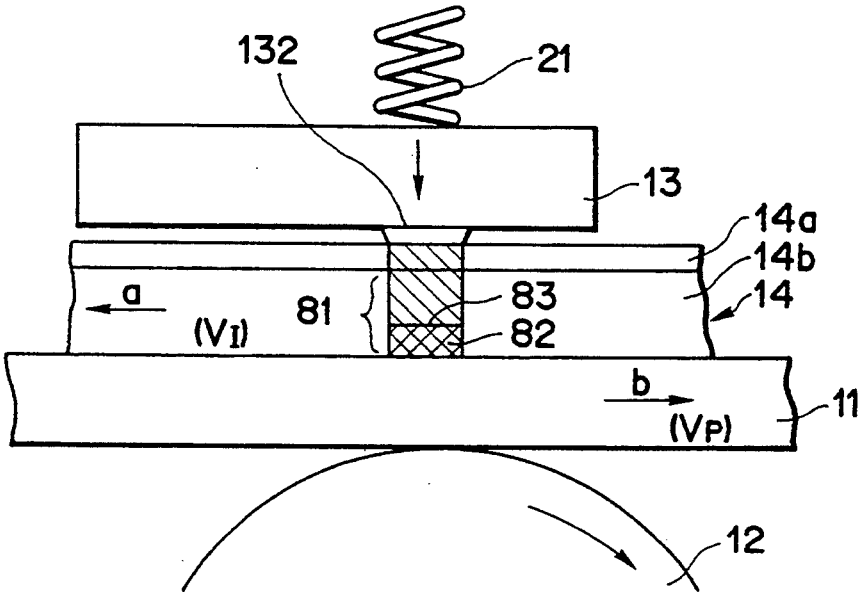
FIG. 4 shows the structure of the ink sheet and the states of the recording paper and the ink sheet during recording.

Description of the Principle of Recording (FIG. 4)

FIG. 4 shows the image recording condition when image recording is effected with the directions of conveyance of the recording paper 11 and the ink sheet 14 in this embodiment made opposite to each other.

As shown, the recording paper 11 and the ink sheet 14 are nipped between the platen roller 12 and the thermal head 13, and the thermal head 13 is urged against the platen roller 12 with a predetermined pressure by the spring 21. The recording paper 11 is conveyed at a velocity $V_P$ in the direction of arrow b by the rotation of the platen roller 12. On the other hand, the ink sheet 14 is conveyed at a velocity $V_I$ in the direction of arrow a by the rotation of the ink sheet conveying motor 25.

When the heat generating resistance member 132 of the thermal head 13 is electrically energized and heated, that portion of the ink sheet 14 which is indicated by hatching 81 is heated. The reference character **14*a* designates the base film of the ink sheet 14, and the reference character 14*b* denotes the ink layer of the ink sheet 14. The ink of the ink 10 layer 81 heated by the heat generating resistance member 132 being electrically energized is melted and the portion thereof indicated by 82 is transferred to the recording paper 11. This transferred ink layer portion 82 corresponds to approximately 1/n of the ink layer indicated by 81**.

During this transfer, it is necessary that a shearing force to the ink be created in the border line 83 of the ink layer **14*b* and only the ink layer portion indicated by 82 be transferred to the recording paper 11. This shearing force differs depending on the temperature of the ink layer, and tends to become smaller as the temperature of the ink layer becomes higher. So, if the heating time of the ink sheet 14 is shortened, the shearing force in the ink layer will become greater and therefore, if the relative velocity of the ink sheet 14 and the recording paper 11 is increased, the ink layer to be transferred can be positively peeled from the ink sheet 14**.

According to this embodiment, the heating time of the thermal head 13 in the facsimile apparatus is as short as about 0.6 ms and therefore, by making the direction of conveyance of the ink sheet 14 and the direction of conveyance of the recording paper 11 opposite to each other, the relative velocity of the ink sheet 14 and the recording paper 11 is increased.

Also, this embodiment has been described with respect to a case where the directions of conveyance of the recording paper 11 and the ink sheet 14 during recording are opposite to each other, whereas this is not restrictive, but the present invention can also be applied to a case where recording is effected with the recording paper and the ink sheet conveyed in the same direction.

Figure 5:
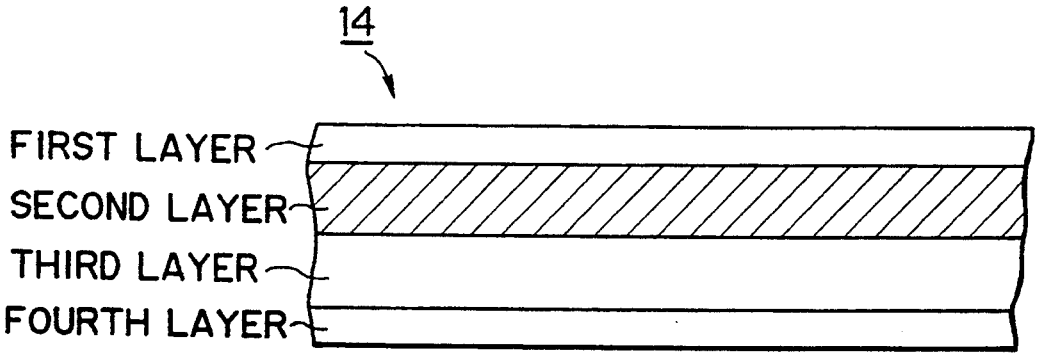
FIG. 5 is a cross-sectional view of the ink sheet used in this embodiment.

Description of the Ink Sheet (FIG. 5)

FIG. 5 is a cross-sectional view of the ink sheet used in the multiprint of the present embodiment, and here the ink sheet is constructed of four layers.

First, a second layer is a base film which provides a back-up member for the ink sheet 14. In the case of multiprint, heat energy is applied to the same portion many times and therefore, this layer may advantageously be an aromatic polyamide film of hight heat resisting property or condenser paper, but the conventional polyester film will also stand use. The thickness of this layer may advantageously be as small as possible in respect of the quality of printing from the viewpoint of the role as a medium, and may desirably be 3–8 μm from the viewpoint of strength.

A third layer is an ink layer containing therein an amount of ink transferable to the recording paper (the recording sheet) n times. The chief components of this layer are resin such as EVA as an adhesive agent, carbon black or nigrosine dye for coloring, carnauba wax or paraffin wax as a binding material, etc. and these are combined so as to stand n times of use in the same portion. The amount of application of these materials is desirably be 4–8 $g/m^2$ but sensitivity and concentration differ depending on the amount of application and thus, the amount of application can be arbitrarily selected.

A fourth layer is a top coating layer for preventing the ink of the third layer from being pressure-transferred to the recording paper in the portion thereof which is not to be printed, and is formed of transparent wax or the like. Thus, it is only the transparent fourth layer that is pressure-transferred, and the ground of the recording paper can be prevented from being stained. A first layer is a heat resisting coat layer for protecting the base film which is the second layer from the heat of the thermal head 13. This is suitable for multiprint in which heat energy corresponding to n lines may be applied to the same portion (when black information is continuous), but the use or non-use thereof can be suitably chosen. Also, it is effective for a base film of relatively low heat resisting property such as a polyester film.

The construction of the ink sheet 14 is not limited to this embodiment, but it may comprise, for example, a base layer and a porous ink retaining layer provided on one side of the base layer and containing ink therein, or a base film and a heat resisting ink layer having a fine porous net-like structure and provided on the base layer, said ink layer containing ink therein. Also, the material of the base film may be a film consisting, for example, polyamide, polyethylene, polyester, polyvinyl chloride, triacetyl cellulose, nylon or the like, or paper. Further, the heat resisting coat layer is not always necessary, but the material thereof may be, for example, silicone resin, epoxy resin, fluorine resin, etholocellulose or the like.

Also, as an example of the ink sheet having heat-sublimating ink, mention may be made of an ink sheet comprising a base material formed of polyethylene terephthalate, polyethylene naphthalate, aromatic polyamide film or the like, and a color material layer provided on the base material and containing spacer particles formed of guanamine resin and fluorine resin and a dye.

The heating system is not restricted to the aforedescribed thermal head system using a thermal head, but may also be, for example, an electrical energizing system or a laser transfer system.

Also, the recording medium is not limited to recording paper, but may also be cloth or a plastic sheet if they permit the transfer of ink thereto. The ink sheet is not restricted to the roll construction shown in the embodiment, but may also be, for example, of the so-called ink sheet cassette type in which a cassette removably mountable with respect to the recording apparatus body is bodily mounted and dismounted with respect to the recording apparatus body.

Furthermore, not only the number of times of multiprint marked on the ink sheet or the ink sheet cartridge or the like is read and input, but also the number of times of multiprint of the ink sheet may be automatically judged from a projection, a cut-away or the like formed on the ink sheet cartridge.

As described above, according to this embodiment, when the ink sheet is exchanged and the value of n of that ink sheet is unclear, the value of n is set to a minimum value, whereby the recording density can be prevented from being reduced after the exchange of the ink sheet.

While this embodiment has been described with respect to an example in which a thermal line head is used, this is not restrictive. For example, even when use is made of an ink ribbon of the same material as the ink sheet described in this embodiment and recording is effected by a serial head, multiprint can likewise be realized. That is, in the direction in which the carriage is moved (the recording direction), the amount of take-up of the ink ribbon carried on the carriage is varied correspondingly to the switch 47 or the kind of the ink sheet, whereby multiprint can be accomplished at a desired number of times. When at this time, the carriage is moved, for example, in the rightward direction, the ink ribbon is conveyed so as to move from left to right relative to the thermal head.

The aforedescribed embodiment has been shown with respect to a case where it is applied to a facsimile apparatus, whereas the present invention is not restricted thereto, but the heat transfer recording apparatus of the present invention is also applicable, for example, to a word processor, a typewriter, a copying apparatus or the like.

As described above, according to the present invention, the number of times of multiprint can be designated correspondingly to the frequency of repeated use of the ink sheet. Further, according to the present invention, when the ink sheet is exchanged and the frequency of use of that ink sheet is unclear, the frequency of repeated use is set to a minimum value, whereby a reduction in the recording density after the exchange of the ink sheet can be prevented.

We claim:

1. A thermal transfer recording apparatus for recording an image on a recording medium by transferring an ink from a multiprint ink sheet contained in an ink sheet cassette detachably mountable on said recording apparatus, the apparatus comprising:

recordable number indicating means, provided on said ink sheet cassette, for indicating a recordable number of said ink sheet cassette;

discriminating means for discriminating said recordable number; and control means for controlling said recording when said ink sheet cassette is mounted on said recording apparatus so that a number of recording is performed in response to said recordable number discriminated by said discriminating means, a predetermined number of recording being performed when said recordable number is not discriminated by said discriminating means.

2. A thermal transfer recording apparatus according to claim 1, further comprising conveying means for conveying said recording medium and said ink sheet, said conveying means being controlled by changing a number of steps of a motor.

3. A thermal transfer recording apparatus according to claim 1, wherein said discriminating means automatically discriminates said recordable number.

4. A thermal transfer recording apparatus according to claim 1, wherein a value of said predetermined number is one.

5. A thermal transfer recording apparatus according to claim 1, wherein said predetermined number is manually set when said ink sheet cassette lacking said recordable number indicating means is mounted on said recording apparatus and said discriminating means is incapable of discriminating the recordable number.

6. A thermal transfer recording method of recording an image on a recording medium by transferring an ink from a multiprint ink sheet contained in an ink sheet cassette detachably mountable on a thermal transfer recording apparatus, the method comprising the steps of:

discriminating a recordable number of said ink sheet cassette mounted on said thermal transfer recording apparatus when said ink sheet cassette includes a recordable number indicating means, and not discriminating said recordable number when said ink sheet cassette lacks said recordable number indicating means;

setting said recordable number according to a predetermined recordable number when said recordable number has not been discriminated;

controlling said recording in accordance with said recordable number; and recording on said recording medium by conveying said ink sheet and said recording medium in response to said controlling recordable number.

7. A thermal transfer recording method according to claim 6, wherein a value of said predetermined recordable number is one.

8. A thermal transfer recording method according to claim 6, wherein said predetermined recordable number is manually set when said ink sheet cassette lacking said recordable number indicating means is mounted on said recording apparatus and said discriminating means is incapable of discriminating the recordable number.

9. A thermal transfer recording apparatus for recording an image on a recording medium by transferring an ink from a multiprint ink sheet contained in an ink sheet cassette detachably mountable on said recording apparatus, the apparatus comprising:

recordable number indicating means for indicating a recordable number, said recordable number being provided on said ink sheet cassette;

discriminating means for discriminating substitution of a different said ink sheet cassette and said recordable number indicated by said recordable number indicating means;

recordable number setting means for setting the recordable number discriminated by said discriminating means when said ink sheet cassette is mounted on said recording apparatus, a predetermined recordable number being set when said recordable number is not discriminated by said discriminating means;

ink sheet conveying amount determining means for determining a conveying amount of said ink sheet during recording in accordance with the recordable number set by said recordable number setting means; and ink sheet conveying means for conveying said ink sheet in accordance with the conveying amount determined by said ink sheet conveying amount determining means.

10. A thermal transfer recording apparatus according to claim 9, wherein a value of said predetermined recordable number is one.

11. A thermal transfer recording apparatus according to claim 9, wherein said predetermined recordable number is manually set when said ink sheet cassette having said recordable number indicating means is mounted on said recording apparatus and said discriminating means is incapable of discriminating the recordable number.

* * * * *

UNITED STATES PATENT AND TRADEMARK OFFICE

CERTIFICATE OF CORRECTION

PATENT NO. : 5,371,523

DATED : December 6, 1994

INVENTOR(S) : Satoshi Wada et al

It is certified that error appears in the above-indentified patent and that said Letters Patent is hereby corrected as shown below:

ON THE TITLE PAGE

At [56] References Cited

Under "FOREIGN PATENT DOCUMENTS",

"61-22778 6/1987 Japan" should read --62-122778 6/1987 Japan--.

At [57] Abstract

Line 3, "one" should read --on--.

COLUMN 1

Line 5, "continuation-in-part" should read --continuation--.

COLUMN 2

Line 39, "value," should read --value.--.

COLUMN 3

Line 55, "(demodula-" should read --(modulator-demodula---.

UNITED STATES PATENT AND TRADEMARK OFFICE

CERTIFICATE OF CORRECTION

PATENT NO. : 5,371,523

DATED : December 6, 1994

INVENTOR(S) : Satoshi Wada et al

It is certified that error appears in the above-indentified patent and that said Letters Patent is hereby corrected as shown below:

COLUMN 5

Line 64, "sign-indicates" should read --sign "-" indicates--.

COLUMN 9

Line 23, "etholocel-" should read --ethylcel- --.

Signed and Sealed this

Thirtieth Day of May, 1995

*Attest:*

*Attesting Officer*

BRUCE LEHMAN

*Commissioner of Patents and Trademarks*